US005660135A

United States Patent [19]

Gomes, Jr. et al.

[11] Patent Number: 5,660,135

[45] Date of Patent: Aug. 26, 1997

[54] UNDERWATER APPARATUS RELEASE MECHANISM

[75] Inventors: Walter J. Gomes, Jr., Little Compton; Thomas D. Barron, Portsmouth, both of R.I.

[73] Assignee: The United States of America as represented by the Secretary of the Navy, Washington, D.C.

[21] Appl. No.: 759,358

[22] Filed: Nov. 18, 1996

[51] Int. Cl.[6] ..... B63G 8/00

[52] U.S. Cl. ..... 114/312; 114/322

[58] Field of Search ..... 114/312, 313, 114/321, 322, 330, 331, 333, 337, 338

[56] References Cited

U.S. PATENT DOCUMENTS 3,702,597 11/1972 Odum et al. ..... 114/322
3,724,410 4/1973 Lok ..... 114/322
4,252,467 2/1981 Amrhein ..... 114/322
4,300,254 11/1981 Prior ..... 114/331

*Primary Examiner*—Stephen Avila
*Attorney, Agent, or Firm*—Michael J. McGowan; James M. Kasischke; Prithvi C. Lall

[57] ABSTRACT

An underwater apparatus release mechanism disposed on an unmanned underwater vehicle. A launcher body is joined to the underwater vehicle with a fixed release guide thereon. A shroud is positioned over the front of the underwater apparatus which is disposed on the fixed release guide. A holddown strap is fastened about the shroud, underwater apparatus, and fixed release guide assembly and releasably joined to the launcher body by to release pins. The release pins are joined to a sliding plunger. The plunger is in turn connected to a solenoid which can cause movement of the plunger to release the holddown strap. Hydrodynamic forces cause the shroud and underwater apparatus to slide along the fixed release guide until they are free of the underwater vehicle.

4 Claims, 3 Drawing Sheets

UNDERWATER APPARATUS RELEASE MECHANISM

STATEMENT OF GOVERNMENT INTEREST

The invention described herein may be manufactured and used by or for the Government of the U.S. of America for governmental purposes without the payment of any royalties thereon or therefor.

BACKGROUND OF THE INVENTION (1) Field of the Invention

The present invention relates to a countermeasure launcher and more particularly to a countermeasure launcher used in conjunction with an unmanned underwater vehicle.

(2) Description of the Prior Art

It is well known to launch countermeasures, mines and other deployable equipment by release from surface vessels or aircraft, and it is also well known to launch underwater equipment from the launch tube of a submarine.

In a range environment, it is desirable to release devices such as mines, countermeasures, or instrumentation from unmanned underwater vehicles to simulate a submarine or surface craft. When a torpedo is pursuing a submarine or surface craft, the craft can release countermeasures to confuse the torpedo. In the range environment, an unmanned underwater vehicle is used as a target. Prior to the current invention, these unmanned underwater vehicles had no provision for launching countermeasures or other devices.

An aircraft can deploy a countermeasure or device, but an air dropped device does not have sufficient accuracy and timing to simulate a target and provide accurate test results. A submarine can be used as a target with the capability of deploying countermeasures; however, this is undesirable because of the expense and danger involved.

When testing underwater weapons, countermeasures are commonly released from a barge. The timing of the release must be coordinated with the position of the torpedo and the position of the target device. If the position or timing of the countermeasure release is inaccurate, the test must be conducted again. Multiple barges are necessary to deploy multiple countermeasures at different intervals along the target's path.

SUMMARY OF THE INVENTION

Accordingly, it is a general purpose and object of the present invention to provide a device for deploying a countermeasure or other underwater apparatus from an unmanned underwater vehicle.

It is a further object that such device be capable of deploying the apparatus while the underwater vehicle is in motion.

Another object is that such device allow the vehicle to launch multiple countermeasures.

Still another object is that such device not impede the other capabilities of the launching vehicle.

These objects are accomplished with the present invention by providing an underwater apparatus release mechanism disposed on an unmanned underwater vehicle. A launcher body is joined to the underwater vehicle with a fixed release guide thereon. A shroud is positioned over the front of the underwater apparatus which is disposed on the fixed release guide. A holddown strap is fastened about the shroud, underwater apparatus, and fixed release guide assembly and releasably joined to the launcher body by release pins. The release pins are joined to a sliding plunger. The plunger is in turn connected to a solenoid which can cause movement of the plunger to release the holddown strap. hydrodynamic forces cause the shroud and underwater apparatus to slide along the fixed release guide until they are free of the underwater vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
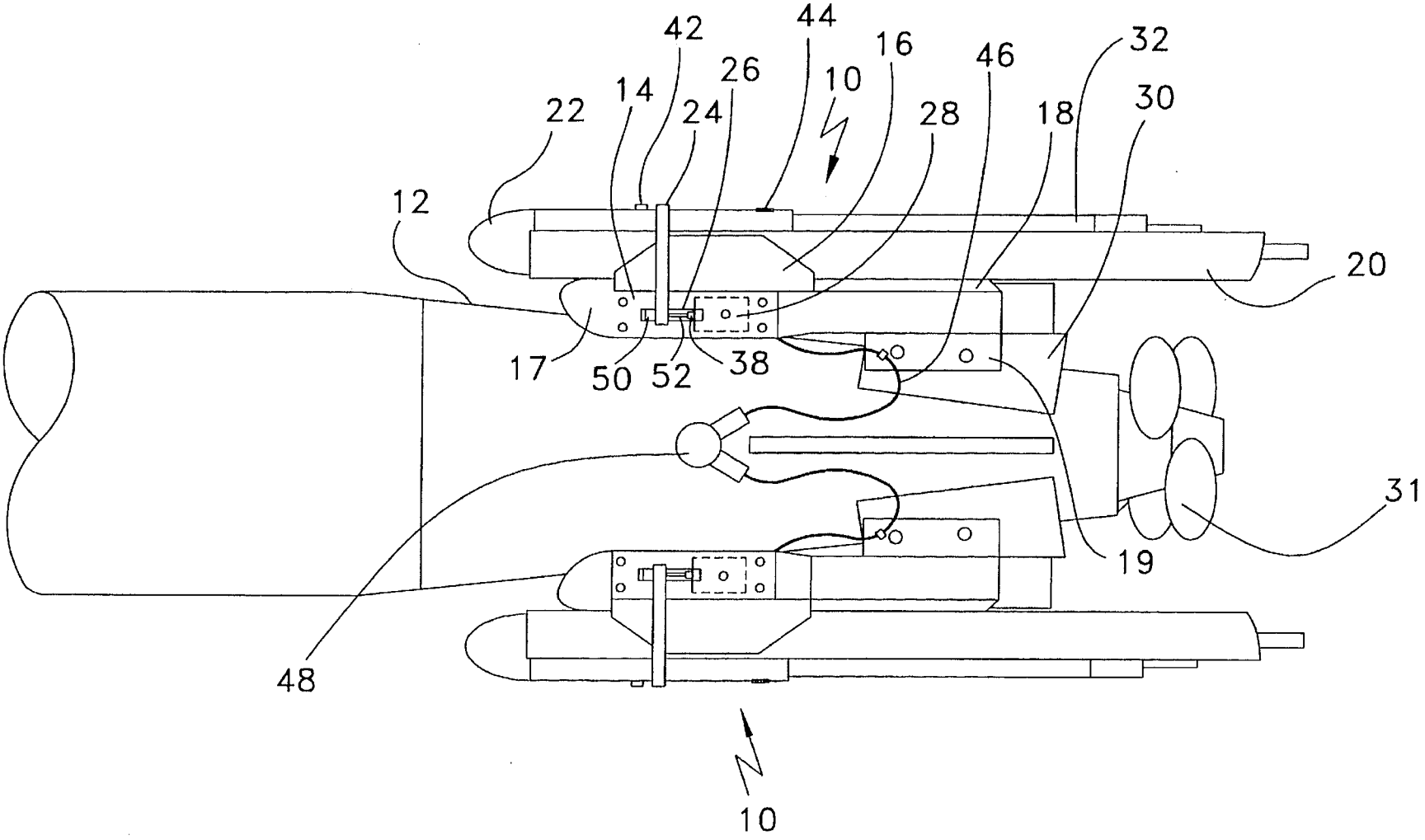
FIG. 1 shows a side view of an underwater vehicle with two underwater apparatus release devices of the current invention attached thereto.

Referring now to FIG. 1, two underwater apparatus release mechanisms 10 of the current invention are shown mounted on a vehicle 12. Vehicle 12 in this instance is a MK 30 surface launched target, but it can be any undersea vehicle. The underwater apparatus release mechanism 10 comprises a launcher body 14, a front support 16, a rear support 18, a fixed release guide 20, a shroud 22, a holddown strap 24, release pins 26 and a solenoid 28. Launcher body 14 is provided with a arcuate hull mounting surface on the forward portion where launcher body 14 will contact vehicle 12. Front support 16 is affixed to the forward portion of launcher body 14 extending away from the axis of vehicle 12. Rear support 18 is affixed to the aft portion of launcher body 14 in a similar manner. The lower surface of launcher body 14 aft portion has a mounting bracket 19 which is bolted to fixed control fins 30 forward of vehicle propellers 31. Front support 16, rear support 18 and launcher body 14 are made from aluminum although any strong, lightweight, corrosion resistant material can be used. Positioned to front of front support 16 is a fairing 17 which is provided to reduce hydrodynamic forces and noise. Fixed release guide 20 is fixed upon front support 16 and rear support 18, and guide 20 is oriented parallel to the axis of vehicle 12. Fixed release guide 20 is elongated and arcuate in cross section, extending forward of front support 16 and aft of rear support 18 to accommodate a countermeasure 32. Shroud 22 is provided to conform to the forward outer surface of countermeasure 32 to reduce hydrodynamic drag on countermeasure 32 and prevent propellers (not shown) on the end of countermeasure 32 from spinning while still allowing the hydrodynamic drag needed for system operation. The top of shroud 22 has a shroud retaining tab 42 and a countermeasure tab slot 33 (FIG. 2) formed therein to accommodate a countermeasure retaining tab 44 on the top of countermeasure 32. Shroud 22 and countermeasure 32 are prevented from sliding axially forward or backward by shroud retaining tab 42 and countermeasure retaining tab 44. Prior to launch, holddown strap 24 is disposed circumferentially about shroud 22 and countermeasure 32 with the extremities of strap 24 passing through guide slots 36 formed in front support 16 and retained by release pins 26 held in place between a plunger 38 and a retaining block 40. Guide slots 36 minimize the force on the release pins 26 while retaining holddown strap 24 about countermeasure 32. Shroud 22 and countermeasure 32 are prevented from sliding axially forward or backward by the interaction between holddown strap 24 and retaining tabs 42 and 44. Vehicle 12 communicates with solenoid 28 via a control cable 46 passing through a penetrator 48 on the hull of vehicle 12.

Shroud 22 is not entirely essential for performance of this invention. Countermeasure 32 can be mounted on guide 20 without shroud 22 in operations when hydrodynamic forces and noise on the vehicle 22 is not critical. In certain operations, omission of shroud 22 can save the cost of providing another expendable part.

Figure 2:
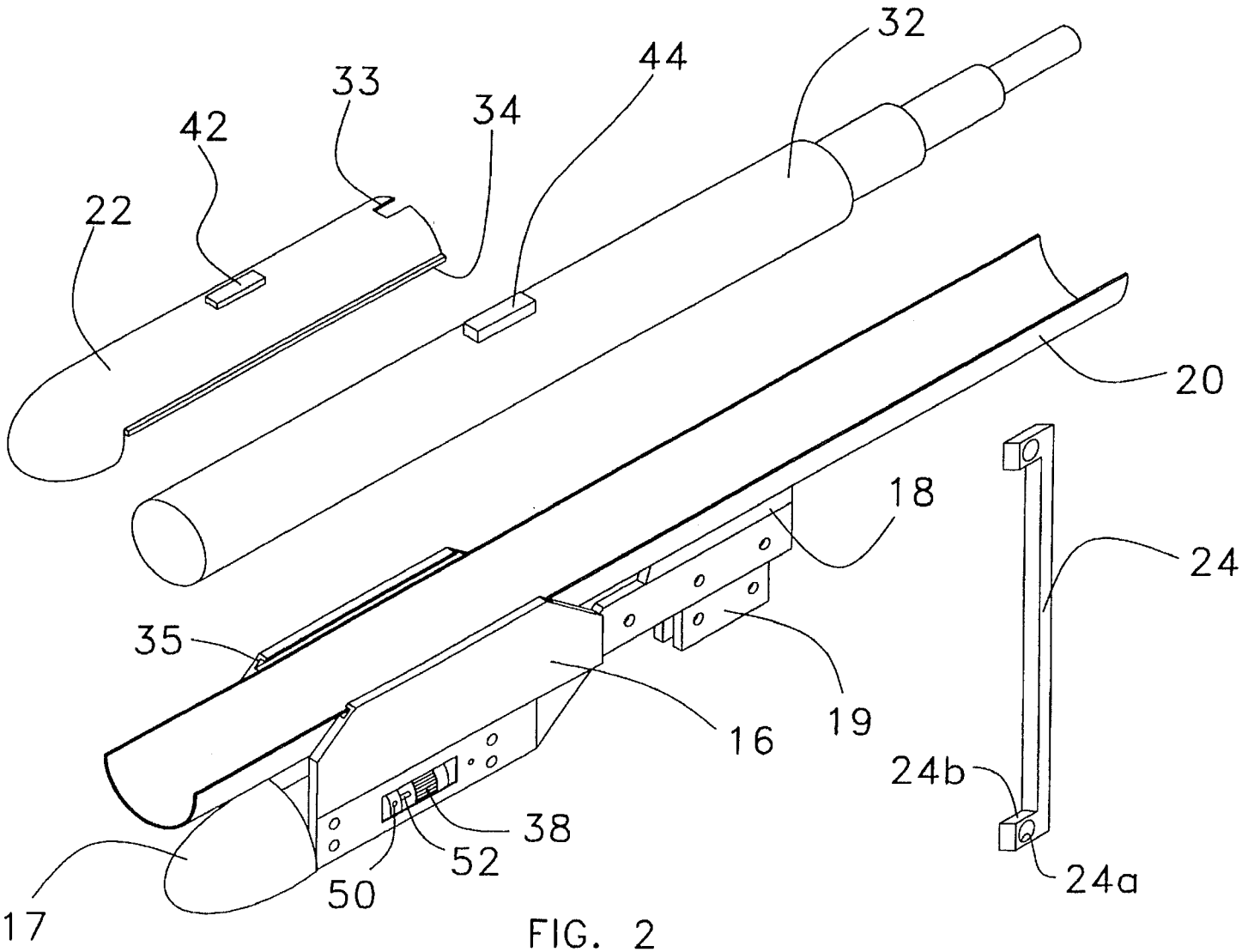
FIG. 2 shows an exploded perspective view of an underwater 2 apparatus release device of the current invention.

Referring now to FIG. 2, there is shown an exploded perspective view of the current invention. The top of shroud 22 has a countermeasure tab slot 33 formed therein to accommodate countermeasure retaining tab 44. As shown in this view, the aft end sides of shroud 22 have low friction guide bars 34 mounted on the external surface of each side of shroud 22 which fit into guide grooves 35 formed in the internal surface of front support 16 brackets. Although any lightweight corrosion resistant materials can be used, fixed release guide 20 and shroud 22 are made from elastomeric materials to conserve weight, and guide bars 34 are made from nylon and a tetrafluoroethylene polymer, such as Teflon, to retard friction. Holddown strap 24 is a flexible, elastomeric strap having a retaining aperture **24*a* in a strap tab 24*b* at each extremity. Strap 24** can be made from a single or multiple pieces of nylon or from another corrosion resistant material having elastic qualities which allow it to be bent around the countermeasure.

Figure 3:
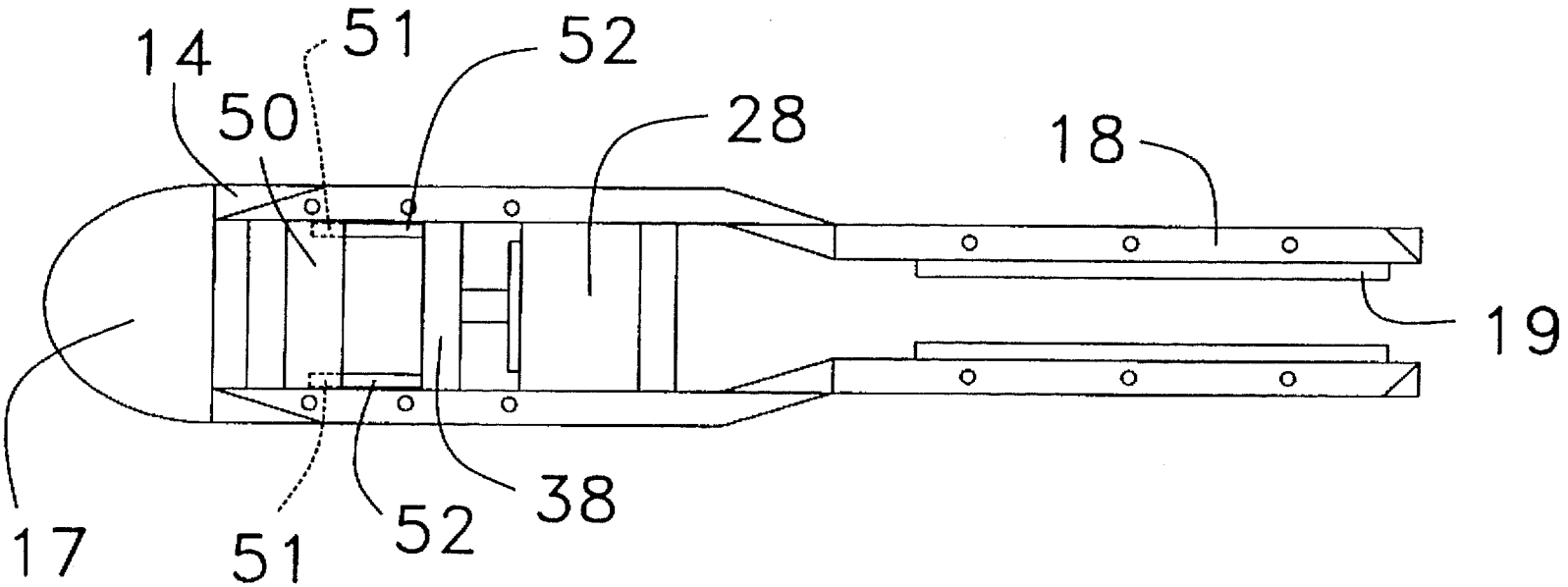
FIG. 3 shows a top view of an underwater apparatus release device of the current invention with the fixed release guide and front support removed to avoid confusion.

Referring now to FIG. 3, there is shown the top of the inventive device with the fixed launch guide and front support removed. A pin retention block 50 having two apertures 51 therein is disposed within guide slots 36 to retain release pins 52 while holddown strap 24 (see FIG. 1) is fastened. Pins 52 are joined to a plunger 38. Plunger 38 is slideably disposed within guide slot 26. Solenoid 28 is linked to plunger 38 to move plunger 38 on receipt of an electrical signal from the vehicle thereby withdrawing pins 52 and releasing holddown strap 24.

Referring again to FIG. 1, to launch countermeasure vehicle 12 transmits an electrical signal through control cable 46 to solenoid 28. Solenoid 28 retracts withdrawing plunger and pulling release pins 26 from holddown strap 24 and retaining block 40. When extremities of holddown strap 24 are released, strap 24 straightens and springs free from about shroud 22 and countermeasure 32. Hydrodynamic forces caused by the motion of vehicle 12 push shroud 22 and countermeasure 32 rearward. When guide bars 34 on shroud 22 no longer engage guide slots 36 on front support 16, countermeasure 32 and shroud 22 are free to travel away from vehicle 12. Guide bars 34 and guide slots ensure that shroud 22 and countermeasure 32 slide straight back when first released. Once the shroud 22 and countermeasure start moving fixed release guide 20 prevents shroud 22 and countermeasure 32 from getting drawn into vehicle 12 propellers Underwater apparatus release mechanism 10 is bolted to one of the fixed fins on vehicle 12 with front support 16 contacting the hull of vehicle 12. Up to four release mechanisms can be bolted to one underwater vehicle thereby allowing an underwater vehicle to launch multiple countermeasures. The countermeasures can be launched at a predetermined time or when the vehicle receives a control signal commanding a launch. The release mechanism allows countermeasures to be released at any time during the operation of the vehicle giving the simulation greater realism because the vehicle does not need to pass a certain location to have a countermeasure deployed. Furthermore, there is no delay between commanded and actual release of the countermeasure.

What has thus been described is an underwater apparatus release mechanism disposed on an unmanned underwater vehicle. A launcher body is joined to the underwater vehicle with a fixed release guide thereon. A shroud is positioned over the front of the underwater apparatus which is disposed on the fixed release guide. A holddown strap is fastened about the shroud, underwater apparatus, and fixed release guide assembly and releasably joined to the launcher body by to release pins. The release pins are joined to a sliding plunger. The plunger is in turn connected to a solenoid which can cause movement of the plunger to release the holddown strap. hydrodynamic forces cause the shroud and underwater apparatus to slide along the fixed release guide until they are free of the underwater vehicle.

Obviously many modifications and variations of the present invention may become apparent in light of the above teachings. For example, many different materials can be used for the system components, and the arcuate launcher body can be fastened to the target.

In light of the above, it is therefore understood that within the scope of the appended claims, the invention may be practiced otherwise than as specifically described.

What is claimed is:

1. An underwater apparatus release mechanism for mounting on an unmanned underwater vehicle to release an underwater apparatus, said mechanism comprising:

a launcher body fastenable to the aft portion of said unmanned underwater vehicle;

a fixed release guide disposed on said launcher body, said fixed release guide being a semicircular channel for accommodating said underwater apparatus and guiding said underwater apparatus past the end of said underwater vehicle;

a holddown strap disposed about said underwater apparatus, and said fixed release guide, said strap having extremities with apertures therein; and a strap release mechanism disposed within said launcher body and removably connected to said holddown strap apertures to release said holddown strap, said release mechanism further joined to said underwater vehicle to receive release commands.

2. The device of claim 1 wherein said strap release mechanism further comprises a shroud detachably disposed on said underwater apparatus having a hydrodynamic forward shroud portion and an aft retaining portion, said shroud fitting on said underwater apparatus, and said holddown strap being disposed about said shroud.

3. The device of claim 2 further comprising at least two guide bars disposed along the length of the outer surface of said shroud retaining portion, and said launcher body extending beyond said fixed release guide and having two guide slots therein corresponding to said guide bars for guiding said shroud and said underwater apparatus upon release.

4. The device of claim 3 wherein said strap release mechanism further comprises:

at least two release pins removably engaging said holddown strap to prevent release of said holddown strap;

a plunger connected to said release pins slidably disposed within said launcher body to remove said release pins; and a solenoid disposed within said launcher body mechanically connected to slide said plunger and electrically connected to said underwater vehicle to move said plunger and release said holddown strap on command from said underwater vehicle.

* * * * *